United States Patent [19]

Cutrone

[11] Patent Number: 4,971,319

[45] Date of Patent: Nov. 20, 1990

[54] TENNIS BALL RETURNER

[76] Inventor: John Cutrone, 1717 3rd Ave N. #9, Lake Worth, Fla. 33460

[21] Appl. No.: 495,100

[22] Filed: Mar. 19, 1990

[51] Int. Cl.[5] ..... A63B 61/00

[52] U.S. Cl. ..... 273/29 B

[58] Field of Search ..... 273/29 B, 29 A, 410, 273/411, 30, 182 R, 29 R, 29 BD

[56] References Cited

U.S. PATENT DOCUMENTS

| | | | |
|---|---|---|---|
| 1,012,820 | 12/1911 | Corby | 273/182 R |
| 2,615,715 | 10/1952 | Moore | 273/29 B |
| 4,083,561 | 4/1978 | Daffer, Jr. | 273/411 |
| 4,203,413 | 5/1980 | Hodges | 273/29 A |
| 4,243,221 | 6/1981 | Ferreira | 273/29 BD |
| 4,457,513 | 7/1984 | Thompson | 273/411 |
| 4,568,089 | 2/1986 | Jenkins et al. | 273/29 B |
| 4,575,081 | 3/1986 | Cavanagh | 273/29 A |
| 4,621,812 | 11/1986 | Salansky | 273/29 A |
| 4,895,366 | 1/1990 | Bartasius | 273/29 B |
| 4,919,421 | 4/1990 | Vandeveld | 273/30 |

FOREIGN PATENT DOCUMENTS

| | | | |
|---|---|---|---|
| 2537310 | 3/1977 | Fed. Rep. of Germany | 273/30 |
| 395830 | 1/1966 | Switzerland | 273/29 R |

*Primary Examiner*—Theatrice Brown

*Attorney, Agent, or Firm*—T. M. Gernstein

[57] ABSTRACT

A tennis ball retriever includes a return net which is located adjacent to the base of a tennis net and which is oriented to bounce tennis balls back to a player after such tennis balls have impacted the tennis net.

14 Claims, 3 Drawing Sheets

TENNIS BALL RETURNER

TECHNICAL FIELD OF THE INVENTION

The present invention relates to the general art of amusement devices, and to the particular field of tennis equipment.

BACKGROUND OF THE INVENTION

Tennis is one of the most popular sports of recent times. More people are playing tennis now than ever before, and there are more tennis tournaments than ever before.

As with any sport, tennis requires practice to perfect the proper stroke for any portion of the game. As has been well documented, a most effective method of practice includes actually hitting tennis balls.

A practice session in which balls are actually hit may involve as many as one hundred balls. Each ball struck must be retrieved after the session ends.

Retrieving practice tennis balls is a time consuming and tedious task which may deter, if not at least inhibit, many players from spending enough time practicing to significantly improve their game.

For this reason, the art has included several devices which are intended to assist a player in collecting tennis balls.

However, while somewhat effective in achieving the overall purpose of making collection of tennis balls more efficient than simply picking them up by hand, these devices are often difficult, complicated and time consuming to install in the first place. Thus, the drawbacks associated with setting up the device are simply substituted for the above-mentioned problems of simply picking up the balls.

Still further, the collection devices often merely collect the balls or do not return them to a location which is convenient to the player. Requiring the player to move a great distance to retrieve a tennis ball vitiates the advantages of such devices.

Therefore, there is a need for a tennis ball returner which is easy to set up, yet will return balls to a player in a manner which reduces the movement required of the player to retrieve the returned ball to a minimum.

OBJECTS OF THE INVENTION

It is a main object of the present invention is to provide a tennis ball returner which is easy to set up.

It is another object of the present invention to provide a tennis ball returner which is easy to set up, yet will return balls to a player in a manner which reduces the movement required of the player to retrieve the returned ball to a minimum.

SUMMARY OF THE INVENTION

These, and other, objects are achieved by a tennis ball returner which includes a net which is attached to stanchions that are located adjacent to the tennis net and which are used to support that net in playing position. The returner includes attaching elements that are easily set up and operated to place the returner in an operating position and is attached to the stanchions by fastening elements such as turnbuckles or the like. Return net support elements are located adjacent to the tennis net and support the return net at an angle with respect to the tennis net.

Using this device, tennis ball which are hit into the tennis net drop against the return net and are deflected by the return net away from the tennis net back towards the player.

Due to the orientation of the return net with respect to the tennis net, no matter what angle the tennis ball initially impacts the tennis net, it will generally be returned to the vicinity of the player. In this manner, the player need not move to great distances to retrieve a returned tennis ball.

BRIEF DESCRIPTION OF THE DRAWING FIGURES

DETAILED DESCRIPTION OF THE PREFERRED EMBODIMENT OF THE INVENTION

Figure 1:
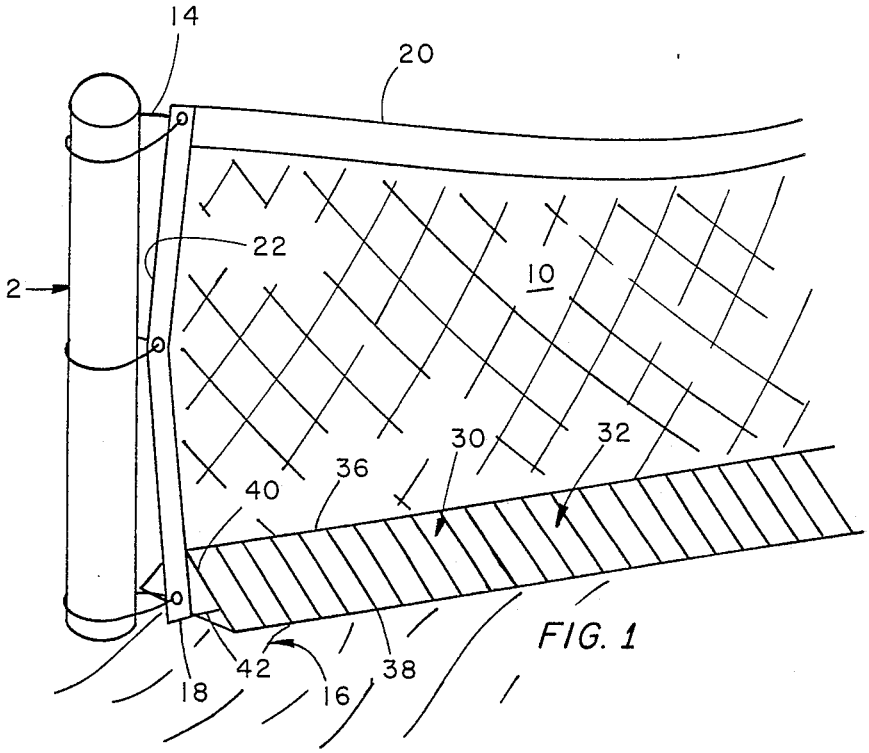
FIG. 1 is a perspective view of tennis net having a tennis ball returner of the present invention associated therewith.

Shown in FIG. 1 is a tennis net 10 mounted in playing position on stanchions, such as stanchion 12 and connected thereto by cords, such as cord 14. The tennis net 10 is contained in a vertically oriented plane and extends upwardly from a playing surface 16, with a lower edge 18 located adjacent to the playing surface, and an upper edge 20 located above that lower edge. In the usual form, the tennis net is rectangular in peripheral shape and also includes end edges, such as end edge 22 located closely adjacent to the support stanchion.

The present invention is embodied in a tennis ball returner 30 that is mounted to be adjacent to the tennis net 10 and in position to return tennis balls that have impacted the tennis net and have fallen downwardly from that impact point towards the playing surface back to the player. The returner 30 includes a return net 32 which is oriented at a skewed angle with respect to the plane containing the tennis net, preferably a forty-five degree angle, and extends along the tennis net so that a tennis ball striking the tennis net will be thrown back away from the net towards the direction of the player. As will be discussed below, this orientation between the return net 32 and the tennis net 10 will cause a returned ball to move close to the player so that the player need not move great distances to retrieve the returned ball.

Figure 2:
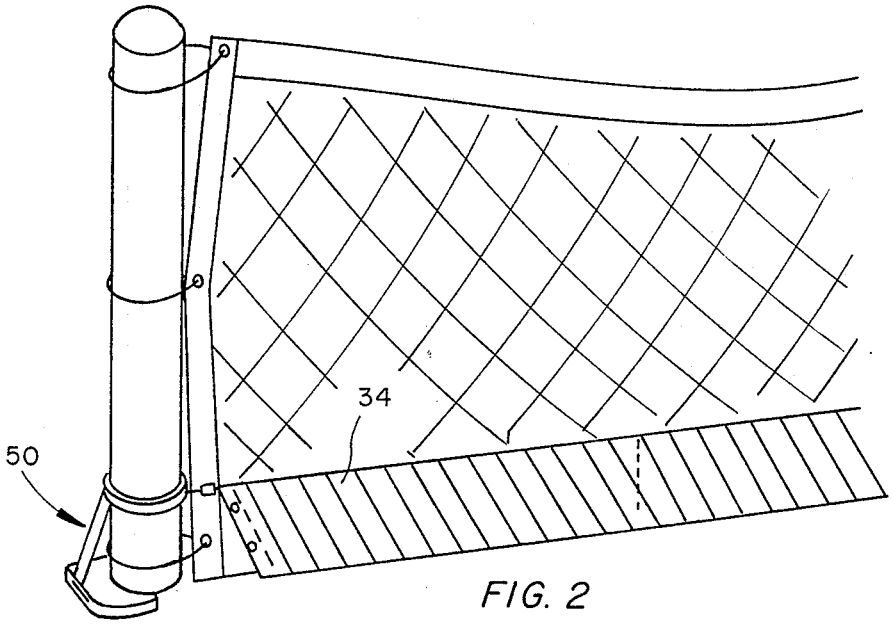
FIG. 2 is a perspective view similar to that shown in FIG. 1 showing the attaching elements used to connect the tennis ball returner to the tennis net and the net stanchions.

Referring to FIGS. 1 and 2, the tennis ball returner return net is seen to include a polygonal body 34, which preferably is rectangular in peripheral shape to have a top edge 36, a bottom edge 38 and end edges, such as end edge 40. The bottom edge 38 is located closely adjacent to the playing surface 16, and the return net slopes towards the tennis net 10 towards the top edge 36 which is located close enough to the tennis net so that a tennis ball will not drop between the top edge 36 and the tennis net, but will contact the upper surface 42 of the net 34. Thus, the top edge of the net 34 is closer to the tennis net than the diameter of a tennis ball, and the net 34 diverges outwardly from that tennis net towards the tennis court backline.

As can be seen in FIGS. 1 and 2, there are two return nets, one on each side of the tennis net. However, both of the return nets are identical, and for the sake of convenience, only one return net will be discussed.

Figure 3:
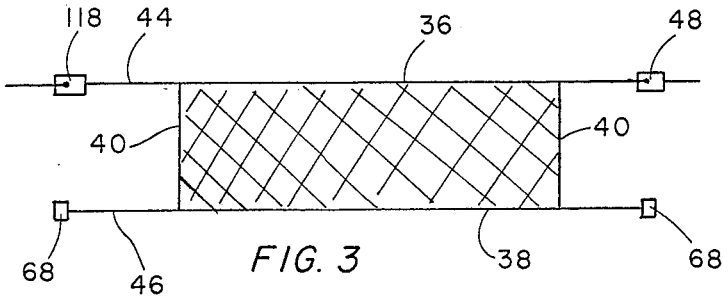
FIG. 3 is a front elevational view of the tennis ball returner embodying the present invention.
Figure 6:
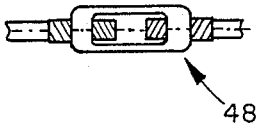
FIG. 6 shows a turnbuckle element which can be used to attach the tennis ball returner to a mounting support element.

Referring to FIGS. 2 and 3, the return net is seen to include two top cords 44 connected to the top edge of the return net at the top corners thereof, two bottom cords 46 connected to the bottom edge of the return net at the bottom corners thereof, and two tightening elements 48, such as turnbuckles shown in FIG. 6, or like fastening elements, connected to the top cords 44. The tightening elements are used to ensure a taut condition for the return net in use.

Figure 4:
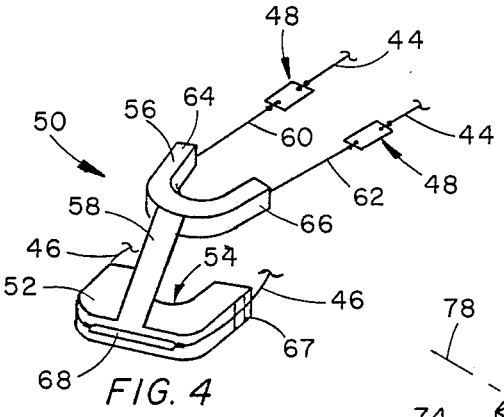
FIG. 4 is a perspective view of a mounting support element used to connect the tennis ball returner net to the tennis net stanchion.

As shown in FIGS. 2 and 4, a mounting support element 50 is positioned adjacent to each tennis net stanchion 12 and supports the return net 34 in the proper position and orientation to return balls falling thereonto from the tennis net 10.

As is shown in FIGS. 2 and 4, each mounting support element 50 includes a U-shaped bottom section 52 that rests on the playing surface with the concave portion 54 thereof located adjacent to the net stanchion 12. A U-shaped top section 56 is connected to the bottom section by a spine section 58 and is located adjacent to the stanchion above the bottom section.

The bottom section is larger than the top section so the spine section is oriented at a skewed angle with respect to vertical and extends toward the stanchion.

The mounting support element 50 further includes two top mounting support cords, 60 and 62 fixedly mounted at a proximal end thereof to the legs 64 and 66 of the top section 56 and having a distal end connected to the tightening elements 48, and the bottom tightening cords 46 extend through loop forming elements such as element 67 mounted on the bottom section. Operation of the tightening elements 48 will pull the top cord of each return net taut.

A bottom cord tightening element, such as a turnbuckle 68 is fixedly mounted on the bottom section 52 adjacent to the spine section 58. One end of the net bottom cord 46 of each return net is attached to the turnbuckle 68, and that turnbuckle is operated to tighten the bottom cords 46.

Figure 5:
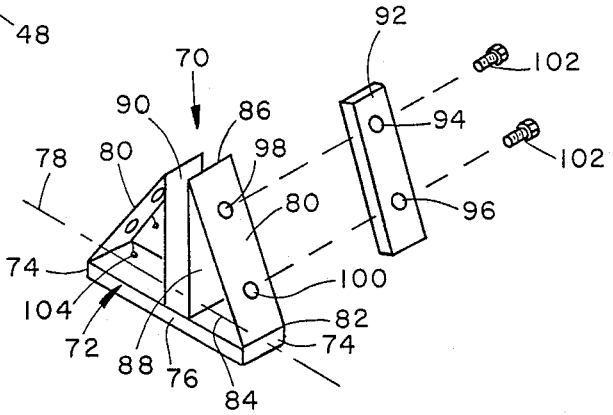
FIG. 5 is an exploded perspective view of a return net support element used to support the return net in ball returning position adjacent to the bottom of a tennis net.

Shown in FIGS. 2 and 5 is a return net support element 70 that is positioned between the return net 34 and the tennis net 10 to support the return net in the FIG. 2 tent-like configuration. There are three support elements 70 for each return net, one adjacent to each end 40 of the return net, and one near the center of such return net. All of the support elements 70 are in the shape of a modified "A" frame, and are all identical. Thus, while the preferred embodiment of the invention will have three support elements 70 for each net 34, and six if two nets are used, only one element 70 will be described.

The support element 70 shown in FIG. 5 includes a base 72 which is rectangular to have end edges 74 and side edges 76, with a longitudinal axis 78 extending between the end edges 74. The support element 70 is located beneath the bottom edge of the tennis net between that bottom edge and the playing surface and is oriented so that the longitudinal axis 78 extends transversely of the plane containing the tennis net. That is, the ends 74 of the base are located on opposite sides of the tennis net, and the side edges 76 intersect the plane containing the tennis net when the support element 70 is in position.

The element 70 further includes a first support arm 80 having a proximal end 82 fixedly secured to the base 72 and extending upwardly from that base at a skewed angle 84 with respect thereto. The first support arms 80 also include distal ends 86 that are coplanar with each other and are located closer to the net 10 than are the proximal ends 82 when the element 70 is in return net supporting position adjacent to the net 10. Preferably, the skewed angle 84 is approximately forty-five degrees, and a second support arm 88 connects the distal end 86 of each first arm 80 to the base 72. The first arms converge toward each other from the proximal ends toward the distal ends, and the second arms are essentially parallel and spaced apart from each other to define a net receiving gap 90 therebetween.

The element 70 further includes a cap 92 which is shaped and sized to match the second arms 80. The cap 92 includes two fastener-receiving holes 94 and 96 defined therethrough, and the first arms 80 also include two fastener-receiving holes 98 and 100 defined therethrough. The cap fastener-receiving holes are located to be aligned with corresponding ones of the first arm fastener-receiving holes so that fasteners, such as wing screws 102 which co-operate with nuts 104, can be inserted through such aligned holes to fasten a cap to each first arm. The return net 34 is captured between the first arm 80 and the cap 92 to be supported and connected to the element 70.

The tennis ball returner is set up by simply locating the return net 34 adjacent to the tennis net, locating the mounting support elements 50 adjacent to the stanchions, connecting the bottom cords 46 to the fasteners 68, and the top cords 44 and 62 to the fasteners 48, and tightening the fasteners 48 and 68 until the return net is in position. Since the mounting support element base section 52 is wider than the mounting support element top section 56, tightening the fasteners 48 and 68 will orient the net 34 at an angle to the tennis net 10. The return net support elements 70 are then positioned, and the return net fastened to each element 70 by fastening the caps 92 to the first arms 80 with the net 34 captured therebetween. The return net 34 is then in position at a forty-five degree angle with respect to the tennis net, and the tennis net is received in the gaps 90 with the first arm distal ends 86 located closer to the net 10 than the diameter of a tennis ball so that tennis balls impacting the tennis net will fall downwardly onto the tightened return net 34. Such balls will then be redirected back towards the player.

Figure 7:
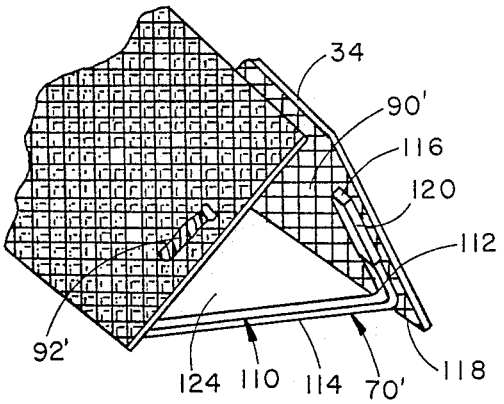
FIG. 7 is an end perspective view of a ball return net being supported by an alternative form of a return net support element.

An alternative form of the return net support element is shown in FIG. 7 at 70'. This element 70' includes a monolithic base 110 that has two inwardly converging arms 112 on each end of a bight section 114. The arms 112 have distal ends 116 that are located closer to the tennis net than the proximal ends 118 thereof connected to bight section ends. A pad 120 of hook-and-loop fastening material is fixed to the arms 112 near the distal ends thereof, and a cap 92 has hook-and-loop material thereon to be fixed to the pads 120 and to capture the tennis net between the caps and the arms. The arms 112 are spaced apart to define a gap 90' therebetween to receive the tennis net. A reinforcing plate 124 is mounted on top of the bight section to prevent the arms 112 from bending inwardly under the force of the tightened net 34.

Figure 8:
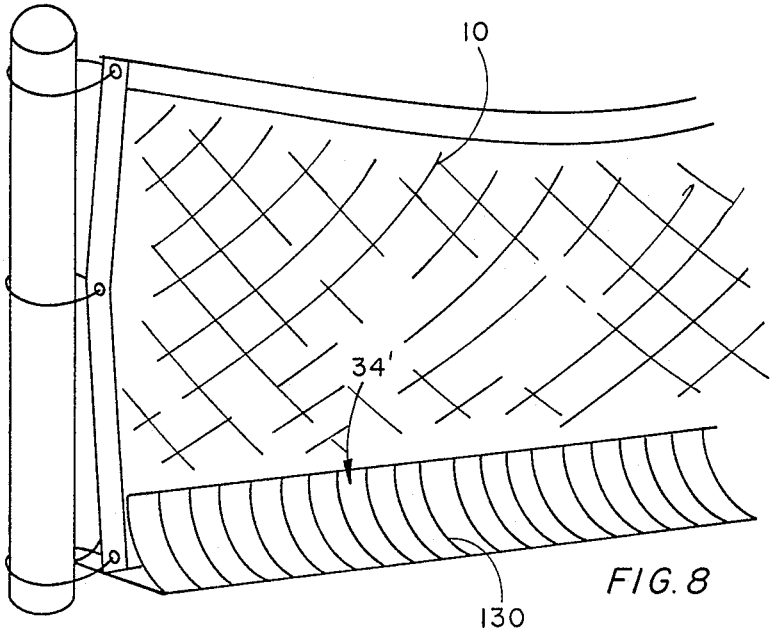
FIG. 8 is a perspective view-showing a curved form of the return net.

The return net can be curved as shown for net 34' in FIG. 8 so that a concave surface 130 faces outwardly of the net 10 towards the player.

Figure 9:
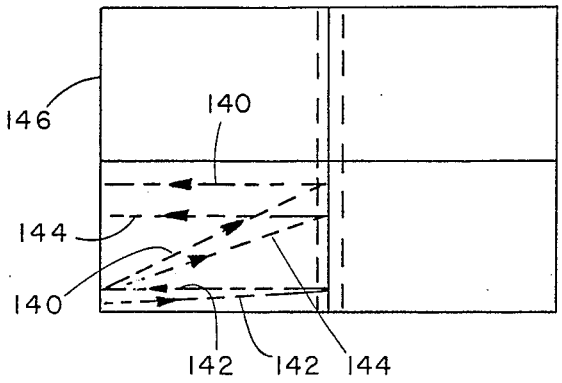
FIG. 9 is a top plan view schematically illustrating various return paths for a tennis ball impacting a tennis net and being returned by the tennis ball returner of the present invention.

As discussed above, the return net of the present invention returns a tennis ball to the player. This return is such that the player need not move too far to reach a returned ball. This is achieved by the net 34 as indicated in FIG. 9. The ball impacts the tennis net 10 at any angle, and drops straight down due to the flexibility of the tennis net. This downward drop essentially removes the angular orientation of the ball with respect to the net since this angular orientation is in a horizontal plane, and the ball drops in a vertical plane.

The net 34 is resilient in the nature of the tennis net 10, and thus when the ball drops onto that net 34, it will be bounced with energy added. Such additional energy will ensure that the ball will roll all the way to the baseline so that a player serving the ball will have the ball roll all the way back to him. The net 34 is oriented with respect to the tennis net and with respect to the baseline of the court so that the ball dropping onto that net from above will be sent directly backwards towards the baseline away from the plane of the tennis net. Thus, no matter what angle the ball initially contacts the tennis net, it will roll directly backwards towards the baseline and not at an angle thereto so as to be directed perpendicularly towards the baseline rather than at some angle thereto. This redirection of the ball is indicated in FIG. 9 where the ball rolls back towards the baseline at a right angle no matter what the impact angle is between the ball and the tennis net. Thus, the double dash line 140 represents one angle of impact, the triple dot line 142 represents another angle of impact, and the double dash line 144 represents an intermediate angle of impact. However, all of the balls are returned along a path that is perpendicular to the baseline 146 so that all of the balls will be returned to areas that are relatively close to the player.

It is understood that while certain forms of the present invention have been illustrated and described herein, it is not to be limited to the specific forms or arrangements of parts described and shown.

I claim:

1. A tennis ball returner comprising:

(A) a return net adapted to be located substantially parallel to and adjacent to a tennis net near the bottom of such tennis net, said return net in use having a bottom edge located adjacent to a tennis playing surface near a bottom edge of the tennis net and a top edge located above said bottom edge, said return net being oriented at a skewed angle with respect to the tennis net to diverge away from the tennis net from said return net top edge to said return net bottom edge, and including a top cord connected to said return net top edge, and a bottom cord connected to said return net bottom edge;

(B) a top cord tightening element connected to said return net top cord;

(C) a bottom cord tightening element connected to said return net bottom cord;

(D) a mounting support element adapted to be located adjacent to each support post supporting the tennis net and including a bottom section, a top section, a spine section connecting said support element top section to said support element bottom section, a top mounting support cord attached to said top cord tightening element, and said bottom cord tightening element being mounted in said mounting support element bottom section; and (E) a return net support element which includes an elongated base which, in use, extends beneath the bottom edge of the tennis net, a first support arm attached at a bottom end to said return net support element base, and extending upwardly at a skewed angle towards the tennis net when said return net support element is in position to support said return net in a ball returning position, a second support arm connecting a top end of said return net support element first support arm to said return net support element base and extending vertically and located adjacent to the tennis net when said return net support element is in said return net supporting position, a cap element mounted on said return net support element first support arm and fastens said return net to said return net support element first support arm, and fastening means for releasably fastening said cap element to said return net support element first support arm.

2. The tennis ball returner defined in claim 1 including a return net on each side of the tennis net.

3. The tennis ball returner defined in claim 2 wherein said return net support element skewed angle is approximately forty-five degrees.

4. The tennis ball returner defined in claim 3 wherein said top cord tightening element includes a first turnbuckle and said bottom cord tightening element includes a second turnbuckle.

5. The tennis ball returner defined in claim 4 further including a loop element mounted on said mounting support element bottom section.

6. The tennis ball returner defined in claim 5 wherein said return net is rectangular in peripheral shape and further includes two side edges, with top corners formed at an intersection of said top edge with said side edges, and bottom corners formed at the intersection of said side edges and said bottom edge, said top cord being connected to said top corners and said bottom cord being connected to said bottom corners.

7. The tennis ball returner defined in claim 6 including a return net support element located adjacent to each side edge of said rectangular return net and another return net support element located between said rectangular return net side edges.

8. The tennis ball returner defined in claim 7 wherein said return net is planar.

9. The tennis ball returner defined in claim 7 wherein said return net is concave between said return net top and bottom edges.

10. The tennis ball returner defined in claim 7 wherein said mounting support element top and bottom sections are U-shaped, with said bottom section being larger than said top section.

11. The tennis ball returner defined in claim 10 wherein said spine section is sloped at a skewed angle with respect to vertical.

12. The tennis ball returner defined in claim 11 wherein said return net support element further includes another first support arm attached at a bottom end thereof to said return net support element base at a location spaced from said return net suPport element first support arm and extending upwardly at skewed angle therefrom towards the tennis net and towards said return net support element first support arm, another second support arm connecting a top end of said another first support arm to said return net support element base at a location spaced from said return net support element second support arm and extending vertically, and said another second support arm being parallel to said return net support element second support arm and being spaced therefrom and defining a gap therebetween into which the tennis net is received.

13. The tennis ball returner defined in claim 12 wherein the top edges of said return net support element first support arm and said another first support arm are coplanar.

14. The tennis ball returner defined in claim 13 wherein said return net is formed of resilient net material.

* * * * *